US007491300B2

(12) United States Patent
Hunt

(10) Patent No.: US 7,491,300 B2
(45) Date of Patent: Feb. 17, 2009

(54) APPARATUS AND METHOD FOR INITIATING A COMBUSTION REACTION WITH SOLID STATE SOLID FUEL

(75) Inventor: Jeffrey H. Hunt, Thousand Oaks, CA (US)

(73) Assignee: The Boeing Company, Chicago, IL (US)

( * ) Notice: Subject to any disclaimer, the term of this patent is extended or adjusted under 35 U.S.C. 154(b) by 1011 days.

(21) Appl. No.: 10/761,542

(22) Filed: Jan. 21, 2004

(65) Prior Publication Data

US 2005/0155853 A1 Jul. 21, 2005

(51) Int. Cl.
*C07C 1/00* (2006.01)
*F23C 15/00* (2006.01)
*C10L 1/12* (2006.01)

(52) U.S. Cl. ..... 204/157.15; 431/1; 431/2; 44/904

(58) Field of Classification Search ..... 431/1, 431/2; 44/904; 204/157.15
See application file for complete search history.

(56) References Cited

U.S. PATENT DOCUMENTS 4,276,463 A * 6/1981 Kime ..... 219/121.62
5,756,924 A * 5/1998 Early ..... 102/201

OTHER PUBLICATIONS

Vorob'ev et al., "Laser Pulse Combustion of Solid Fuel", Pis'ma v Zhurnal Tekhnicheskoi Fiziki (no month, 1990), vol. 16, No. 19, pp. 79-83. Abstract Only.*
Zhang, "Laser-Induced Ignition of Pulverized Fuel Particles", Combustion and Flame (no month, 1992), vol. 90, pp. 134-142.*

* cited by examiner

*Primary Examiner*—Edna Wong
(74) *Attorney, Agent, or Firm*—Harness, Dickey & Pierce, P.L.C.

(57) ABSTRACT

A method is provided for initiating and sustaining a combustive reaction in a solid fuel. The method includes generating at least one pulsed optical signal and directing the pulsed optical signal to a plurality of ignition points within at least one combustion chamber containing a solid fuel. The pulsed optical signal is generated by an optical source, e.g. a laser pump, and modulated using an intensity profiler. The intensity profiler modulates the pulsed optical signal to initially have a first peak power sufficient to initiate a combustive reaction in a solid fuel. The intensity profiler further modulates the pulsed optical signal to subsequently have a second peak power sufficient to sustain the combustive reaction until sufficient exothermic energy is released by the combustive reaction to make the reaction self-sustaining.

24 Claims, 3 Drawing Sheets

APPARATUS AND METHOD FOR INITIATING A COMBUSTION REACTION WITH SOLID STATE SOLID FUEL

CROSS REFERENCE TO RELATED APPLICATIONS

This application is related to copending U.S. patent application Ser. No. 10/007,994, titled Apparatus And Method For Initiating A Combustion Reaction With Slurry Fuel, filed on Nov. 8, 2001.

FIELD

The present disclosure relates to fuel ignition and, more specifically, to optically initiated chemical reactions to establish combustion in a propulsion engine using storable high-density solid state solid fuels.

BACKGROUND

Solid state solid fuels are propulsion fuels that are in solid form when stored at ambient temperatures. As with most any material that is in a solid phase, the mass density and energy density of the fuel is much high in the solid state than when in a liquid or gas phase. As a result, the specific impulse and thrust potential from the fuel is much higher in solid state solid fuels, herein also referred to as solid fuels. However, fuels are more difficult to ignite using traditional electric spark or torch-ignition techniques when in a solid state than when in a liquid or gas form.

Therefore, it would be highly desirable to provide an efficient and sufficiently simple method of initiating a combustive reaction in a solid fuel.

SUMMARY

In various implementations, the present disclosure provides a method for initiating and sustaining a combustive reaction in a solid fuel. The method includes generating at least one pulsed optical signal and directing the pulsed optical signal to a plurality of ignition points within at least one combustion chamber containing a solid fuel. The pulsed optical signal is generated by an optical source, e.g. a laser pump, and modulated using an intensity profiler. The intensity profiler modulates the pulsed optical signal to initially have a first peak power sufficient to initiate a combustive reaction in a solid fuel. The intensity profiler further modulates the pulsed optical signal to subsequently have a second peak power sufficient to sustain the combustive reaction until sufficient exothermic energy is released by the combustive reaction to make the reaction self-sustaining.

In other implementations, the present disclosure provides a propulsion system including at least one combustion chamber. The combustion chamber receives a solid fuel and oxidizer mixture used to provide propulsion by igniting the mixture. The propulsion system additionally includes at least one optical source for generating at least one pulsed optical signal used to ignite and sustain a combustive reaction of the solid fuel and oxidizer mixture. An optical fiber coupler connected to the optical source directs the pulsed optical signal to a plurality of ignition points within the combustion chamber. Furthermore, the propulsion system includes an intensity profiler adapted to modulate the pulsed optical signal to have a first peak power sufficient to initiate the combustive reaction. The intensity profiler further modulates the pulsed optical signal to have a second peak power sufficient to sustain the combustive reaction. The pulsed optical signal sustains the combustive reaction until sufficient exothermic energy is released by the combustive reaction to make the reaction self-sustaining.

The features, functions, and advantages of the present disclosure can be achieved independently in various embodiments of the present disclosure or may be combined in yet other embodiments.

BRIEF DESCRIPTION OF THE DRAWINGS

The present disclosure will become more fully understood from the detailed description and the accompanying drawings, wherein.

Corresponding reference numerals indicate corresponding parts throughout the several views of drawings.

DETAILED DESCRIPTION

The following description of the various embodiments is merely exemplary in nature and is in no way intended to limit the disclosure, its application or uses. Additionally, the advantages provided by the various embodiments, as described below, are exemplary in nature and not all embodiments provide the same advantages or the same degree of advantages.

Figure 1:
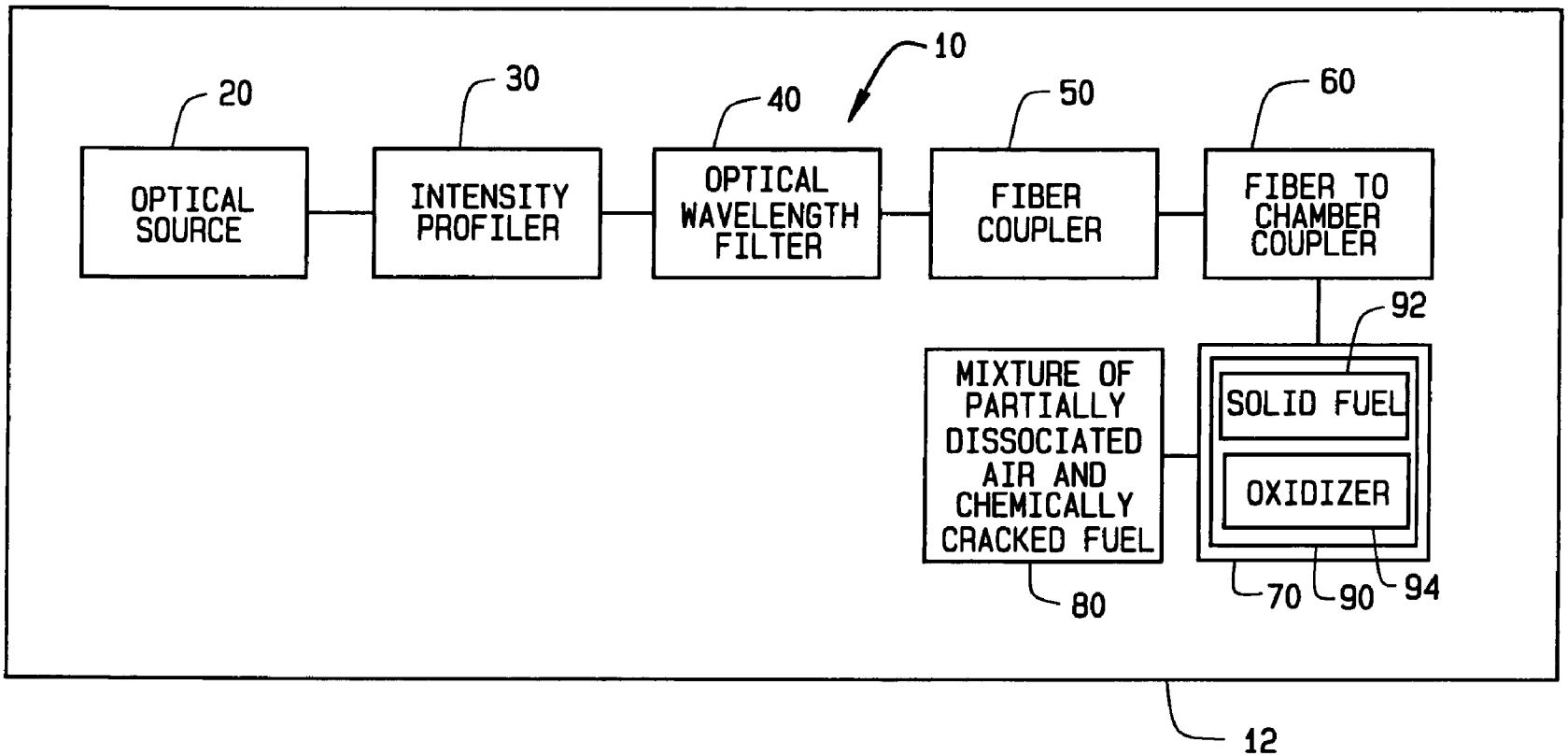
FIG. 1 is a block diagram of the optically initiated propulsion system of the present disclosure.

With initial reference to FIG. 1, an optically initiated propulsion system 10 according to the present disclosure is illustrated. The propulsion system 10, shown operatively disposed in a vessel 12, includes an optical source 20 such as a laser for producing coherent light. A fiber coupler 50, comprising one or more optical fiber, optically connects optical source 20 with a solid fuel and oxidizing agent mixture 90, also referred to herein as solid fuel/oxidizer mixture 90, in a combustion chamber 70. An intensity profiler 30 and optical wavelength filter 40 are incorporated between optical source 20 and fiber coupler 50. A fiber to chamber coupler 60 is used to interconnect the fiber coupler 50 with the solid fuel/oxidizer mixture 90. The optical initiation of combustion of the solid fuel/oxidizer mixture 90 yields a mixture of partially dissociated air and chemically cracked fuel 80.

In various embodiments, the fiber coupler 50 comprises a collection or series of optical fibers in a bundle. The fibers interconnect with multiple ignition positions within a single combustion chamber 70. Having multiple ignition positions with a single combustion chamber 70 increases the ease of igniting the solid fuel and the ease in sustaining the combustive reaction. Alternatively, the optical fibers interconnect with multiple combustion chambers 70 within the vessel 12. The collection of fibers may be designed in several ways. In one form, each optical fiber connects with a separate optical source 20. Each fiber directs the optical energy to a single ignition point. In an alternative form, the fiber coupler 50 includes an optical splitter adapted to receive a single pulsed optical signal from the optical source 20 and divide the signal into a plurality of pulsed optical signals. The optical splitter splits the optical energy and directs the optical energy to one of multiple ignition points. The optical optical splitter can be any suitable optical splitter, for example, an active coupler in which an optical pulse enters the coupler and is optically switched to one of the output optical fibers. In this manner, the optical energy can be serially directed to each of the output fibers.

The propulsion produced by any engine is the result of an exothermic chemical reaction. In order to ignite the engine, the activation energy of the chemical reaction must be overcome. As with any chemical reaction, the microscopic behavior is dictated by quantum mechanical behaviors. The inherent stochastic nature of the quantum behaviors implies that there is a probability distribution associated with the ignition. In a gas phase ignition, the activation energy is overcome by applying energies well above a threshold value. Typically, for solid fuels, different areas have different threshold energies. Small differences in the chemical constituents will also change the propagation of a flame front, once ignition is achieved. This can lead to local flameouts, whose location cannot be determined ahead of time. These difficulties can be mitigated by increasing the number of ignition points within the solid fuel structure, as described above. In alternative embodiments, to assure ignition, multiple optical signals can be sent to one or more ignition points.

The characteristics of laser light emitted from the optical source 20 will now be described in greater detail. Characteristics associated with laser light must be optimized for optically initiating combustion. These characteristics can include laser pulse duration, pulse intensity envelope shape, laser energy within the envelope, peak optical power, center wavelength and frequency bandwidth. Optimization of these characteristics involves selecting the characteristics to assure that maximum coupling of optical energy into the molecular bonds of materials in the propulsion mixture. In the case of a solid fuel, additional constraints need to be imposed. For example, the laser light wavelength must be short enough so that absorption via linear or nonlinear mechanisms leads to molecular dissociation of fuel, oxidizer or both. The shape of the intensity envelope can control not only the amount, but also the deposition speed of energy into the internal molecular energy states.

The implication is that the light must be in the ultraviolet range of the spectrum, for example, shorter than 300 nanometers. In most practical applications, a diode-pumped solid state laser will be used as optical source 20 because of its mechanical robustness. The light from these lasers, however, will typically be in the near infrared, requiring nonlinear optical conversion to shorter wavelengths. After the conversion is accomplished, there will be remnants of longer wavelengths in the laser light. Before introduction into the fiber coupler 50, optical wavelength filter 40, or an equivalent filtering medium, removes any residual light at longer wavelengths.

For ignition to occur in a solid fuel 92, a balance must be reached between the light energy absorbed into the fuel/oxidizer mixture 90 and the volume of the mixture that is excited. In other words, the absorbed energy density of the mixture is as important as the absorbed energy itself. If too much energy is deposited in a highly localized volume of solid fuel 92, it will not be sufficient to allow the exothermic chemical reaction to reach a self-initiating condition. In normal gas or liquid phase fuels, nonlinear effects are highly independent of absolute position in the volume because the local density fluctuations do not affect the local optical susceptibility. However, for solid fuels, tailoring the optical intensity is very important. This is because the interaction with the solid fuel/oxidizer mixture 90 will begin with a nonlinear optical absorption. Thus, the light emitted from optical source 20 can be in a pulsed format so that high peak laser powers can be generated. Generally, the peak power associated with a laser generated pulse is equal to the energy in the pulse divided by the duration of the pulse. As an example, a laser pulse may only contain 1 millijoule of energy emanated from a one milliwatt laser in one second. This does not represent a large amount of energy. However, if that one millijoule of energy is contained within a pulse that is, for example, one to three nanoseconds in duration, then the peak power is one Gigawatt. Even though the pulse duration is short, the surrounding medium will react to the laser pulse as if it were a one Gigawatt power laser, although the effect will only last the duration of the laser pulse. In this manner, sufficient energy in each pulse generates a peak power that is associated with the onset of nonlinear optical behavior, for example approximately 1-2 Megawatts.

Additionally, the pulse shape and/or format of the optical signal emitted from the optical source 20 is modulated by the intensity profiler 30 for optimized interaction with the high densities associated with the solid fuel 92. Because the initial absorption volume in the solid fuel 92 will be small due to the higher density, it will be advantageous to output an optical pulse from the optical source 20 having a high peak power at the beginning of the pulse and a lower peak power during a later portion of the pulse. Also, the nature of the solid fuel 92 will lead to larger density fluctuations that cause changes in the local absolute value of an electric field associated with the light signal emitted from optical source 20. In any medium, the local electric field is due to both an applied field and a field induced in the medium. The nonlinear optical process is dependent on this local field. Consequently, any nonlinear optical process may begin at slightly different intensity levels at different locations within the solid fuel/oxidize mixture 90. Further yet, because of the high density of the solid fuel 92, the solid fuel 92 will be generally less transparent than gas or liquid materials. Therefore, as a result of the optical opacity of the solid fuel 92, the solid fuel 92 will absorb a high percentage of the laser light emitted from optical source 20, disproportionate to the light absorbed by the surrounding media. More specifically, the lower transparency results in a higher degree of light absorption that aids in coupling, i.e. routing, the optical energy into internal energy and consequently heating of the fuel/oxidizer mixture 90.

The dissociation of the molecules in both the solid fuel 92 and the oxidizer 94 is associated with light wavelengths in the ultraviolet shorter than 300 nm. The association with the light wavelengths is due to the fact that the electronic excitations leading to the dissociation of the molecules characteristically occur with internal energies that exceed 3 electron-volts (ev). The internal heating of molecules, that is, the excitation of energy level corresponding to vibration motion, is associated with light wavelengths in the infrared, longer than 900 nm. Furthermore, the high absorption creates an unusual situation wherein molecular dissociation and molecular heating processes are simultaneously enhanced. More specifically, the molecular dissociation and molecular heating processes proceed more quickly and at higher efficiency levels due to the high absorption. For this reason, the intensity of the laser signal emitted from the optical source 20 is profiled to have a high peak power at the initiation of ignition, when molecular dissociation dominates the physical process, and a lower power level after ignition is established, when internal heating dominates the process.

Thus, the internal heating sustains the combustive reaction until sufficient exothermic energy is released to make the reaction self-sustaining.

Figure 2:
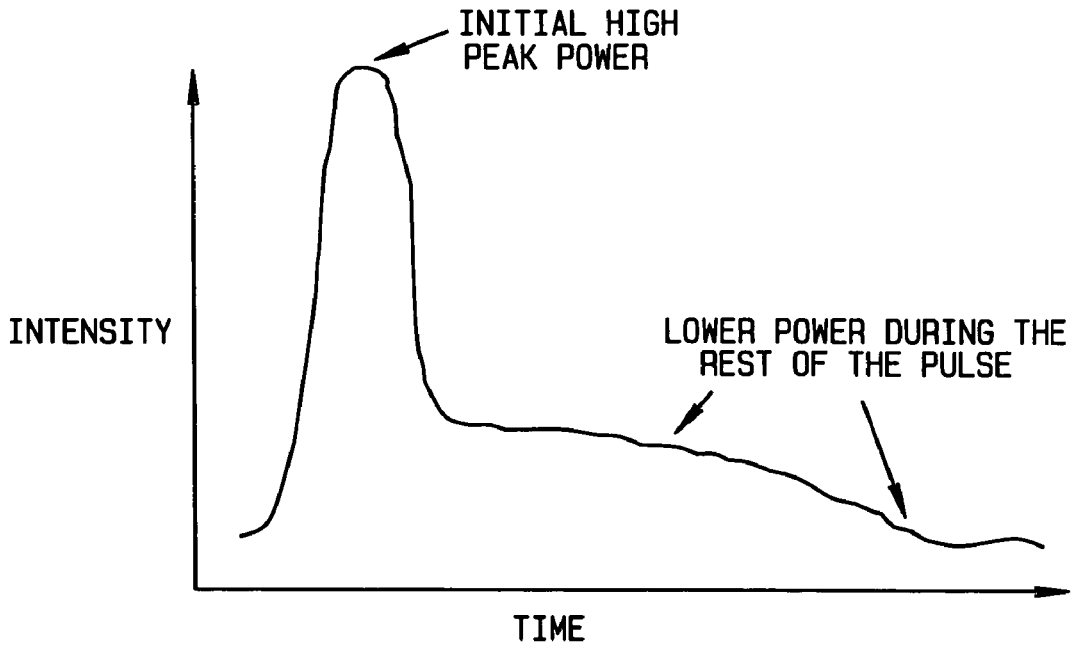
FIG. 2 is a graphical representation of a light pulse over time according to various embodiments of the present disclosure.

The intensity profiler 30 will now be described in greater detail. It will be appreciated by those skilled in the art that the location of intensity profiler 30 is merely exemplary and may be positioned subsequent to optical wavelength filter 40. In various embodiments, shown in FIG. 2, the intensity profiler 30 modulates the optical signal emitted from the optical source 20 such that the signal has a high initial peak power at its leading edge and a lower peak power during the remainder of the pulse. The energy level at the leading edge of the signal is sufficient to initiate a combustive reaction in, i.e. ignite, the solid fuel/oxidizer mixture 90. Subsequently, the energy level during the remainder of the signal is sufficient to sustain the combustive reaction occurring in the solid fuel/oxidizer mixture 90 until sufficient exothermic energy is released to make the reaction self-sustaining.

Figure 3:
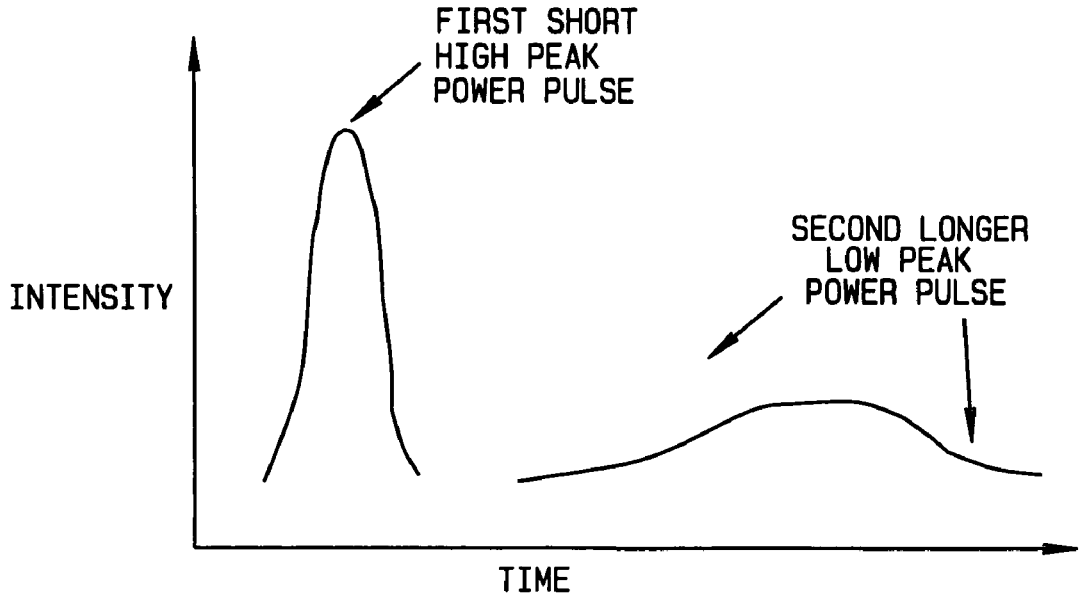
FIG. 3 is a graphical representation of a first and second light pulse over time according to other embodiments of the present disclosure.

In other embodiments, shown in FIG. 3, the optical source 20 emits two or more pulses. The intensity profiler 30 modulates the pulses such that an initial pulse has high peak power and a predetermined duration and pulses subsequent to the initial pulse have a lower peak power and a predetermined duration. The pulses are emitted from the optical source in a temporally serial fashion. The energy level of the initial pulse is sufficient to initiate a combustive reaction in, i.e. ignite, the solid fuel/oxidizer mixture 90. Subsequently, the energy level during the subsequent pulse(s) is sufficient to sustain the combustive reaction occurring in the solid fuel/oxidizer mixture 90 until sufficient exothermic energy is released to make the reaction self-sustaining. This pulsing sequence can be used one time in an engine with steady flow, or it can be used multiple times and be regulated to create a desired sequence of ignitions.

When used multiple times at multiple points of ignition, a variety of pulse sequences and the ability to switch the pulses to different areas, allows the exact ignition timing sequence can be controlled. Several locations may be ignited simultaneously or specific physical locations can be ignited before other locations. For example, it may be advantageous to ignite the center of the solid fuel/oxidizer mixture 90 first, with the ignition of the outer areas being ignited later. In this manner, the ignition flame front from the first ignition area will reach other areas of the solid fuel/oxidizer mixture 90 and the subsequent ignition pulses will arrive at the same time as the ignition flame front. As a result, the exothermic energy of the flame will coincide with the optical energy, leading to a fuel state that contains more internal molecular energy, increasing the probability for sustained ignition.

In each embodiment, the initial high peak power will quickly generate a micro-plasma that is opaque to most laser wavelengths. The time elapsed between the high and low power excitations is short enough such that all the energy of the lower peak power will be uniformly absorbed without causing other undesirable nonlinear optical processes to interfere with the optical initiation. For example, the time between the high and lower power excitations can be less than ten nanoseconds, but possibly as long as 100 nanoseconds.

The ignition of the solid fuel/oxidizer mixture 90 using optical source 20 will now be described in greater detail. The equation governing the optical intensity to drive the optical breakdown is given by:

$$I_{cr}=\{mcE_I(1+(\omega\tau)^2)]/[2\pi e^2\tau J\}[g+1/\tau_\rho \log_e(\rho_{cr}/\rho_0)]$$

Where $\rho_{cr}$ is the critical electron number for breakdown, $\tau_\rho$ is the laser pulse width; m, e, c are the electron constants; $\omega$ is the optical field frequency; $E_I$ is the ionization energy of the fuel 92 or the oxidizer 94; $\tau$ is the momentum transfer collision time; g is the electron loss rate; and $\rho_0$ is the "initial" electron density. Although this depends on the particular characteristics of the solid fuel/oxidizer mixture 90, the propulsion system 10 is designed to deliver the level of optical intensity into the combustion chamber 70, as dictated by the equation. The optical energy delivered in accordance with the equation is the pulsed optical energy described above that is delivered into the combustion chamber 70 to initiate and sustain the propulsion reaction.

Once a finite number of solid fuel 92 and/or oxidizer 94 molecules have been dissociated, the resulting physical state is an optically opaque medium. The dissociation occurs when sufficient energy is absorbed by the molecular bond such that the electrons associated with that bond can no longer bond the atoms together. This process is very fast, for example, by the end of a one nanosecond pulse, the dissociations have already occurred. All the subsequent energy in the laser pulse is absorbed into this medium. Additionally, the optical spot size of the optical signal is a function of the intensity at which the fuel oxidizer molecules break down. For example, the optical intensity is increased by using a smaller optical spot size, therefore, the spot size will affect the optical intensity and consequently the strength of the nonlinear optical absorption. Thus, the absorption leads to the molecular dissociation necessary for ignition of the solid fuel/oxidizer mixture 90.

The breaking down of solid fuel 92 is generally simple because metal particles in the solid fuel 92 both increase optical absorption and enhance the optical nonlinearity of the media. For example, peak powers of approximately 1-2 Megawatts at ultraviolet wavelengths, for example, less than 300 nanometers, will be sufficient to initiate breakdown, with the breaking down beginning to occur near the densest volumes of the solid fuel 92. Internal energies sufficient to drive the mixture into a self-sustaining condition can then be generated with a lower power portion of the same pulse or with a lower power second laser pulse to complete the initiation of the reaction. The initiation is complete when the exothermic energy of the reaction is sufficient to continue driving the reaction, i.e. the reaction is self-sustaining. This self-sustaining chemical reaction is the combustion reaction that produces the engine propulsion.

Generally, optical delivery systems, such as optical source 20, can generate laser energies on the order of 10 millijoules. Fiber coupler 50 is adapted to transmit pulses that simultaneously have a high peak power and a short wavelength. In various embodiments, fiber coupler 50 includes one or more non-solarizing optical fibers that support the high peak power and short wavelength requirements and transmit the pulse(s) with substantially no loss of energy or intensity. For example, the absorption volume in the solid fuel 92 can be on the order of approximately 100 to 115 cubic microns. A corresponding energy density of approximately 5 to 15 GJ/cubic meter can then be produced to initiate combustion. Through the use of non-linear absorption, enough free electrons are created within a high intensity focus region of the solid fuel/oxidizer mixture 90 to allow the solid fuel/oxidizer mixture 90 to take on the absorption characteristic of plasma. Generally, plasma ranges from highly absorbing to completely opaque and allows for a finite fraction of the pulse energy to be absorbed by the medium, e.g. the solid fuel/oxidizer mixture 90.

In addition, the high density of the solid fuel 92 enhances the optical nonlinearity of the medium. The nonlinearity of the solid fuel/oxidizer mixture 90 is used to enhance the absorption process that leads to the initiation of the chemical reaction. The resulting mixture 80 after ignition will be comprised of partially dissociated air and chemically cracked fuel. The mixture includes molecular and atomic oxygen, an array of hydrocarbon fragments, low molecular weight hydrocarbon compounds and some remaining parent carrier fuel.

Figure 4:
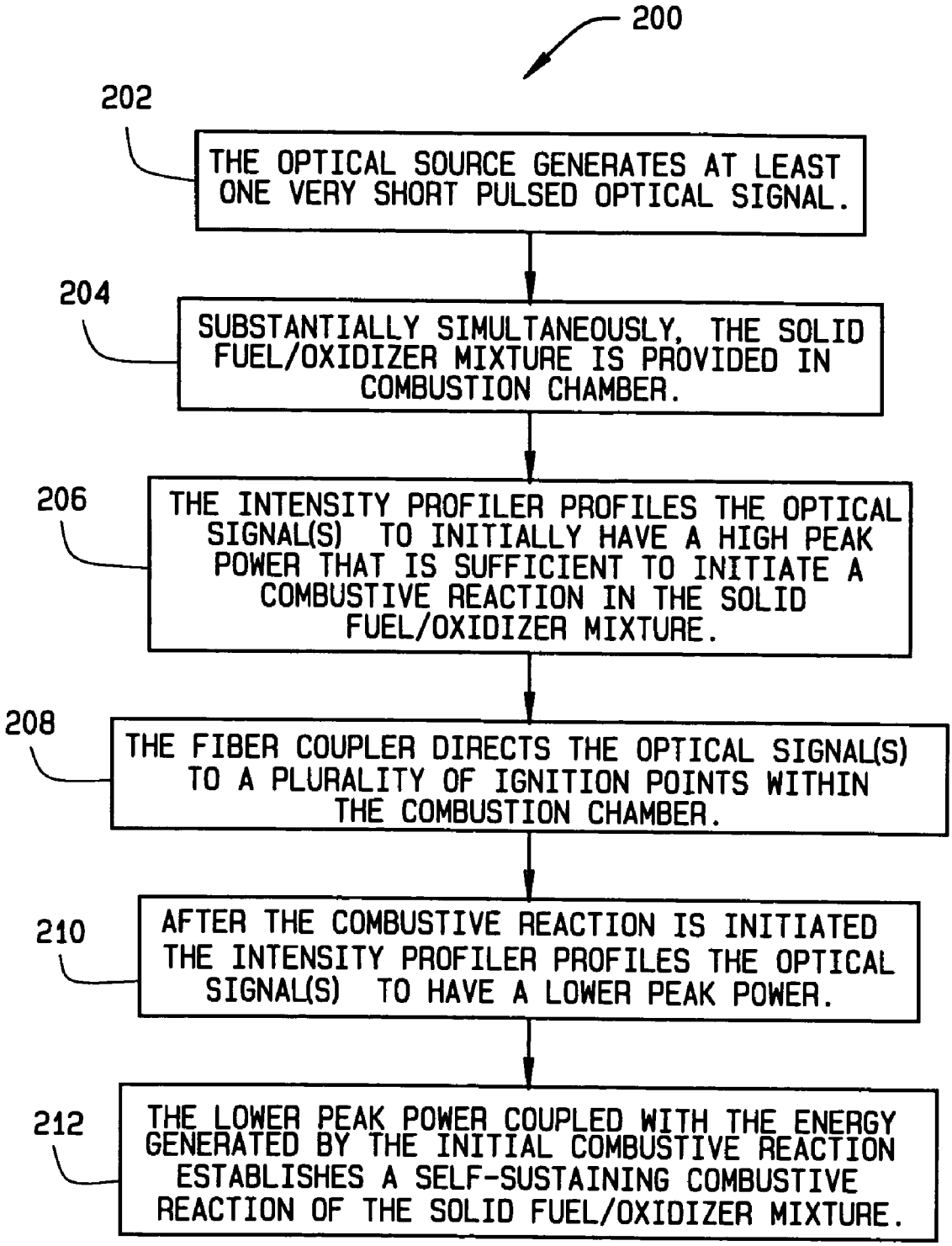
FIG. 4 is a graphical representation of the method of optical ignition according to the present disclosure.

FIG. 4 is a flow chart 200 illustrating a method of initiating and sustaining a combustive reaction in the solid fuel/oxidizer mixture 90, in accordance with a various embodiments of the present disclosure. To begin the combustive reaction, the optical source 20 generates at least one very short pulsed optical signal, as indicated at 202. Substantially simultaneously, the solid fuel/oxidizer mixture 90 is provided in combustion chamber 70, as indicated at 204. The intensity profiler 30 profiles, i.e. modulates, the optical signal(s) to initially have a high peak power that is sufficient to initiate a combustive reaction in the solid fuel/oxidizer mixture 90, as indicated at 206. The fiber coupler 50 directs the optical signal(s) to a plurality of ignition points within the combustion chamber 70, as indicated at 208. After the combustive reaction is initiated the intensity profiler 30 profiles the optical signal(s) to have a lower peak power, as indicated at 210. The lower peak power coupled with the exothermic energy generated by the combustive reaction establishes a self-sustaining combustive reaction of the solid fuel/oxidizer mixture 90 that occurs until the solid fuel/oxidizer mixture is substantially completely burned, i.e. disassociated, as indicated at 212.

While the present disclosure has been described in terms of various specific embodiments, those skilled in the art will recognize that the disclosure can be practiced with modification within the spirit and scope of the claims.

What is claimed is:

1. A method for initiating and sustaining a combustive reaction in a solid fuel, said method comprising:

generating at least one pulsed optical signal;

directing the pulsed optical signal to a plurality of ignition points within a single combustion chamber containing the solid fuel;

modulating the pulsed optical signal to initially have a first peak power sufficient to initiate a combustive reaction in the solid fuel; and modulating the pulsed optical signal to subsequently have a second peak power sufficient to sustain the combustive reaction once the combustive reaction is initiated.

2. The method of claim 1, wherein directing the pulsed optical signal comprises utilizing an optical fiber coupler including a plurality of optical fibers to transmit the pulsed optical signal to the plurality of ignition points.

3. The method of claim 1, wherein generating at least one pulsed optical signal comprises generating a plurality of pulsed optical signals.

4. The method of claim 3, wherein directing the pulsed optical signal comprises directing each of the pulsed optical signals to at least one of the plurality of ignition points.

5. The method of claim 1, wherein generating at least one pulsed optical signal comprises generating the pulsed optical signal to have a wavelength sufficiently short so that absorption of the pulsed optical signal by the solid fuel leads to molecular disassociation of the solid fuel.

6. The method of claim 1, wherein generating at least one pulsed optical signal comprises generating the pulsed optical signal to have a duration sufficiently short so that the signal will have sufficient energy to generate the combustive reaction of the solid fuel.

7. The method of claim 1, wherein modulating the pulsed optical signal to initially have a first peak power comprises modulating the pulsed optical signal to have a first portion having a peak power sufficient to initiate the combustive reaction in the solid fuel.

8. The method of claim 7, wherein modulating the pulsed optical signal to have a second peak power comprises modulating the pulsed optical signal to have a second portion having a peak power sufficient to sustain the combustive reaction until sufficient exothermic energy is released by the combustive reaction to make the reaction self-sustaining.

9. The method of claim 1, wherein modulating the pulsed optical signal to initially have a first peak power comprises modulating a plurality of pulsed optical signals wherein a first pulsed optical signal has a peak power sufficient to initiate the combustive reaction in the solid fuel.

10. The method of claim 9, wherein modulating the pulsed optical signal to have a second peak power comprises modulating at least one second pulsed optical signal generated subsequent to the first pulsed optical signal to have a peak power sufficient to sustain the combustive reaction until sufficient exothermic energy is released by the combustive reaction to make the reaction self-sustaining.

11. The method of claim 10, wherein generating at least one pulsed optical signal comprises generating the first pulsed optical signal a predetermined time prior to generating the second pulsed optical signal so that all the energy of the second pulsed optical signal will be uniformly absorbed by the solid fuel without causing undesirable optical processes to interfere with the initiation of the combustive reaction.

12. The method of claim 1, wherein modulating the pulsed optical signal comprises modulating the pulsed optical signal in accordance with the equation:

$$I_{cr}=\{mcE_I(1+(\omega\tau)^2)]/[2\pi e^2\tau I\}/g+1/\tau_\rho \log_e(\rho_{cr}/\rho_0)]$$

where $\rho_{cr}$ is the critical electron number for breakdown, $\tau_\rho$ is the or optical signal pulse width; m, e, c are the electron constants; $\omega$ is the optical field frequency; $E_I$ is the ionization energy of the solid fuel or an oxidizer; $\tau$ is the momentum transfer collision time; g is the electron loss rate; and $\rho_0$ is the initial electron density.

13. A method for initiating and sustaining a combustive reaction of a solid fuel contained in a combustion chamber, said method comprising:

generating at least one pulsed optical signal;

directing the pulsed optical signal to a plurality of ignition points within a single combustion chamber containing the solid fuel;

initiating the combustive reaction of the solid fuel utilizing the pulsed optical signal modulated to have a first peak power sufficient to initiate the combustive reaction in the solid fuel; and sustaining the combustive reaction of the solid fuel utilizing the pulsed optical signal modulated to have a second peak power sufficient to sustain the combustive reaction until sufficient exothermic energy is released by the combustive reaction to make the reaction self-sustaining.

14. The method of claim 13, wherein directing the pulsed optical signal comprises utilizing an optical fiber coupler including a plurality of optical fibers to transmit the pulsed optical signal to the plurality of ignition points.

15. The method of claim 13, wherein generating at least one pulsed optical signal comprises generating a plurality of pulsed optical signals.

16. The method of claim 15, wherein directing the pulsed optical signal comprises directing each of the pulsed optical signals to at least one of the plurality of ignition points.

17. The method of claim 13, wherein generating at least one pulsed optical signal comprises generating the pulsed optical signal to have a wavelength sufficiently short so that absorption of the pulsed optical signal by the solid fuel leads to molecular disassociation of the solid fuel.

18. The method of claim 13, wherein generating at least one pulsed optical signal comprises generating the pulsed optical signal to have a duration sufficiently short so that the signal will have sufficient energy to generate the combustive reaction of the solid fuel.

19. The method of claim 13, wherein initiating the combustive reaction comprises modulating the pulsed optical signal to have a first portion having the first peak power sufficient to initiate the combustive reaction in the solid fuel.

20. The method of claim 19, wherein sustaining the combustive reaction comprises modulating the pulsed optical signal to have a second portion having the second peak power sufficient to sustain the combustive reaction until sufficient exothermic energy is released by the combustive reaction to make the reaction self-sustaining.

21. The method of claim 13, wherein initiating the combustive reaction comprises modulating a plurality of pulsed optical signals wherein a first pulsed optical signal has the first peak power sufficient to initiate the combustive reaction in the solid fuel.

22. The method of claim 21, wherein sustaining the combustive reaction comprises modulating at least one second pulsed optical signal generated subsequent to the first pulsed optical signal to have a peak power sufficient to sustain the combustive reaction until sufficient exothermic energy is released by the combustive reaction to make the reaction self-sustaining.

23. The method of claim 22, wherein the method further comprises generating the first pulsed optical signal a predetermined time prior to generating the second pulsed optical signal so that all the energy of the second pulsed optical signal will be uniformly absorbed by the solid fuel without causing undesirable optical processes to interfere with the initiation of the combustive reaction.

24. The method of claim 13, wherein initiating and sustaining the combustive reaction comprises modulating the pulsed optical signal in accordance with the equation:

$$I_{cr} = \{mcE_I(1+(\omega\tau)^2)]/[2\pi e^2\tau]\}[g+1/\tau_\rho \log_e(\rho_{cr}/\rho_0)]$$

where $\rho_{cr}$ is the critical electron number for breakdown, $\tau_\rho$ is the optical signal pulse width; m, e, c are the electron constants; $\omega$ is the optical field frequency; $E_I$ is the ionization energy of the solid fuel or an oxidizer; $\tau$ is the momentum transfer collision time; g is the electron loss rate; and $\rho_0$ is the initial electron density.

* * * * *